US012805649B2

(12) United States Patent
Everson et al.

(10) Patent No.: US 12,805,649 B2
(45) Date of Patent: Nov. 24, 2026

(54) SYSTEM WITH A VERSATILE MULTILAYER TEXTILE ASSEMBLY FOR COVERING A SLEEP PLATFORM

(71) Applicant: Everest Linens LLC, Orem, UT (US)

(72) Inventors: Julie Everson, Provo, UT (US); Scott Everson, Provo, UT (US); Emily Everson, Spanish Fork, UT (US)

(73) Assignee: Everest Linens LLC, Orem, UT (US)

( * ) Notice: Subject to any disclaimer, the term of this patent is extended or adjusted under 35 U.S.C. 154(b) by 0 days.

(21) Appl. No.: 19/021,010

(22) Filed: Jan. 14, 2025

(65) Prior Publication Data

US 2026/0198700 A1 Jul. 16, 2026

(51) Int. Cl.
*A47C 31/10* (2006.01)
*D03D 11/00* (2006.01)

(52) U.S. Cl.
CPC ..... *A47C 31/105* (2013.01); *D03D 11/00* (2013.01)

(58) Field of Classification Search
None
See application file for complete search history.

(56) References Cited

U.S. PATENT DOCUMENTS

2024/0285092 A1* 8/2024 Carnrike ..... A47G 9/10

* cited by examiner

*Primary Examiner* — Adam C Ortiz
(74) *Attorney, Agent, or Firm* — Kunzler Needham Hilton; Thomas D Briscoe

(57) ABSTRACT

A transportable sleep system includes any of several selected sleeping platforms and a versatile multilayer textile assembly that is adjustable to fit the selected platform. Any or all of the layers may be selected to have predetermined heating/cooling, supporting, and/or moisture handling properties suitable for a selected user and application environment. The first textile layer has a contact surface for use and a sleeve top surface. The second textile layer has a sleeve bottom surface and a moisture barrier surface. Longitudinal edges of the second layer are attached to the first layer, forming a sleeve for a third textile layer with padding. The second layer is shorter than the first. A fourth textile layer has envelope enclosures to close the sleeve openings. This system is suitable for various users and environments, such as for example, cribs, vehicles, camping, and so forth in different seasons, venues, and other application environments.

20 Claims, 8 Drawing Sheets

SYSTEM WITH A VERSATILE MULTILAYER TEXTILE ASSEMBLY FOR COVERING A SLEEP PLATFORM

FIELD

The present disclosure relates to a system with a versatile textile assembly for covering a sleep platform.

BACKGROUND

Various linens and textiles are available for covering multiple types of sleep platforms. However, existing textiles and linens lack the versatile features of the systems and textile assemblies disclosed herein.

SUMMARY

In various aspects, the techniques described herein relate to an apparatus, wherein the second textile layer includes one or more of: polyurethane laminate (PUL), thermoplastic polyurethane (TPU), organic and non-organic cotton with TPU film, microfiber, Gore-Tex®, Taslan®, nylon, cotton, wool, and/or other suitable fabrics that may be employed.

In various aspects, the techniques described herein relate to an apparatus for adjustably covering a transportable sleeping platform for a user, the apparatus including: a multilayer textile assembly having a longitudinal axis and a transverse axis for conformingly coupling to the transportable sleeping platform including: a first textile layer including a first textile piece with a contact surface that faces away from the transportable sleeping platform during usage for sleeping and a sleeve top surface opposite the contact surface; a second textile layer including a second textile piece with a sleeve bottom surface that faces away from the transportable sleeping platform when covering the transportable sleeping platform, and a moisture barrier surface that faces toward the transportable sleeping platform when covering the transportable sleeping platform, wherein: two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer including one or more envelope enclosures configured to foldably enclose the one or more sleeve openings along one or both of the transverse edges of the sleeve formed between the first textile layer and the second textile layer.

In one or more aspects, the techniques described herein relate to an apparatus, wherein the second textile layer includes at least one of polyurethane laminate (PUL), thermoplastic polyurethane (TPU), cotton with TPU film, microfiber, nylon, textured synthetic fabric, cotton, or wool.

In certain aspects, the techniques described herein relate to an apparatus, further including the third textile layer, wherein the third textile layer includes a selectively insertable padding layer.

In various aspects, the techniques described herein relate to an apparatus, wherein the third textile layer including the selectively insertable padding layer is omitted from being inserted in the sleeve for circumstances in which padding would pose a potential suffocation risk for the user when the user is an infant or another person at risk for suffocation during sleep.

In one or more aspects, the techniques described herein relate to an apparatus, wherein the third textile layer including the selectively insertable padding layer includes a selectable thickness for accommodating the user with a set of predetermined body characteristics in a predetermined set of environmental conditions.

In certain aspects, the techniques described herein relate to an apparatus, wherein for the user that is a toddler, the selectively insertable padding layer includes a thickness of between about 10 mm and about 30 mm.

In various aspects, the techniques described herein relate to an apparatus, wherein the selectively insertable padding layer includes a foam material.

In one or more aspects, the techniques described herein relate to an apparatus, wherein the sleeve includes openings at a first transversal end and at a second transversal end to facilitate: insertion of the selectively insertable padding layer through a first opening of the sleeve at the first transversal end; and adjustment or removal of the selectively insertable padding layer through a second opening of the sleeve at the second transversal end.

In certain aspects, the techniques described herein relate to an apparatus, wherein one or more layers chosen from the group consisting of the first textile layer, the second textile layer, the third textile layer, the fourth textile layer, and combinations thereof, are selected based on a predetermined combination of one or more characteristics chosen from softness, durability, drape, texture, finish, physical weight, thickness, breathability, and/or moisture wicking.

In various aspects, the techniques described herein relate to an apparatus, wherein one or more layers chosen from the group consisting of the first textile layer, the second textile layer, the third textile layer, the fourth textile layer, and combinations thereof, include a cooling material that promotes airflow and/or moisture wicking in a direction towards the transportable sleeping platform.

In one or more aspects, the techniques described herein relate to an apparatus, wherein one or more layers chosen from the group consisting of the first textile layer, the second textile layer, the third textile layer, the fourth textile layer, and combinations thereof, include an insulating material that reduces a rate of heat transfer in a direction towards the transportable sleeping platform.

In certain aspects, the techniques described herein relate to an apparatus, wherein one or more layers chosen from the group consisting of the first textile layer, the second textile layer, the third textile layer, the fourth textile layer, and combinations thereof, include a thermoregulating material selected to: promote cooling via moisture wicking in a direction towards the transportable sleeping platform for use in warm environmental conditions; and trap air to reduce a rate of heat transfer in the direction towards the transportable sleeping platform for use in cool environmental conditions.

In various aspects, the techniques described herein relate to an apparatus, wherein the thermoregulating material is selected from the group consisting of cotton, natural wool, synthetic wool, natural latex, bamboo-derived viscose, synthetic performance fabric, and combinations thereof.

In one or more aspects, the techniques described herein relate to an apparatus, wherein the one or more envelope enclosures are selectively foldable to at least partially enclose a folded arrangement of the first textile layer, the second textile layer, and the third textile layer to form a pillow or cushion for the user.

In certain aspects, the techniques described herein relate to an apparatus, wherein the fourth textile layer includes a textile selected based on a predetermined combination of one or more characteristics chosen from softness, durability, drape, texture, finish, physical weight, thickness, breathability, and/or moisture wicking, and the first textile layer and the fourth textile layer are aesthetically different from one another.

In various aspects, the techniques described herein relate to an apparatus, wherein at least one inward-facing surface of the sleeve includes a friction-enhancing textured material to minimize slippage of the third textile layer within the sleeve.

In one or more aspects, the techniques described herein relate to a transportable sleep system including: a transportable sleeping platform; and an adjustable covering for the transportable sleeping platform for a user, wherein the adjustable covering includes: a multilayer textile assembly having a longitudinal axis and a transverse axis for conformingly coupling to the transportable sleeping platform including: a first textile layer including a first textile piece with a contact surface that faces away from the transportable sleeping platform during usage for sleeping and a sleeve top surface opposite the contact surface; a second textile layer including a second textile piece with a sleeve bottom surface that faces away from the transportable sleeping platform when coupled to the transportable sleeping platform and a moisture barrier surface that faces toward the transportable sleeping platform when coupled to the transportable sleeping platform, wherein: two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer including one or more envelope enclosures configured to foldably enclose the one or more sleeve openings along one or both of the transverse edges of the sleeve formed between the first textile layer and the second textile layer.

In certain aspects, the techniques described herein relate to a transportable sleep system, wherein the transportable sleeping platform is a removable sleeping surface of a crib or a foldable play structure.

In various aspects, the techniques described herein relate to a transportable sleep system, wherein the transportable sleeping platform is configured for use in a vehicle.

In one or more aspects, the techniques described herein relate to a transportable sleep system, wherein the transportable sleeping platform is configured for camping outside of a vehicle.

BRIEF DESCRIPTION OF THE DRAWINGS

In order that the advantages of the subject matter of the present disclosure will be readily understood, a more particular description of the subject matter briefly described above will be rendered by reference to specific examples that are illustrated in the appended drawings. Understanding that these drawings depict only typical examples of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the subject matter of the present disclosure. Appearances of the phrases "In one or more examples," "in an example," and similar language throughout this specification may, but do not necessarily, all refer to the same example. Similarly, the use of the term "implementation" means an implementation having a particular feature, structure, or characteristic described in connection with one or more examples of the subject matter of the present disclosure, however, absent an express correlation to indicate otherwise, an implementation may be associated with one or more examples.

Figure 1:
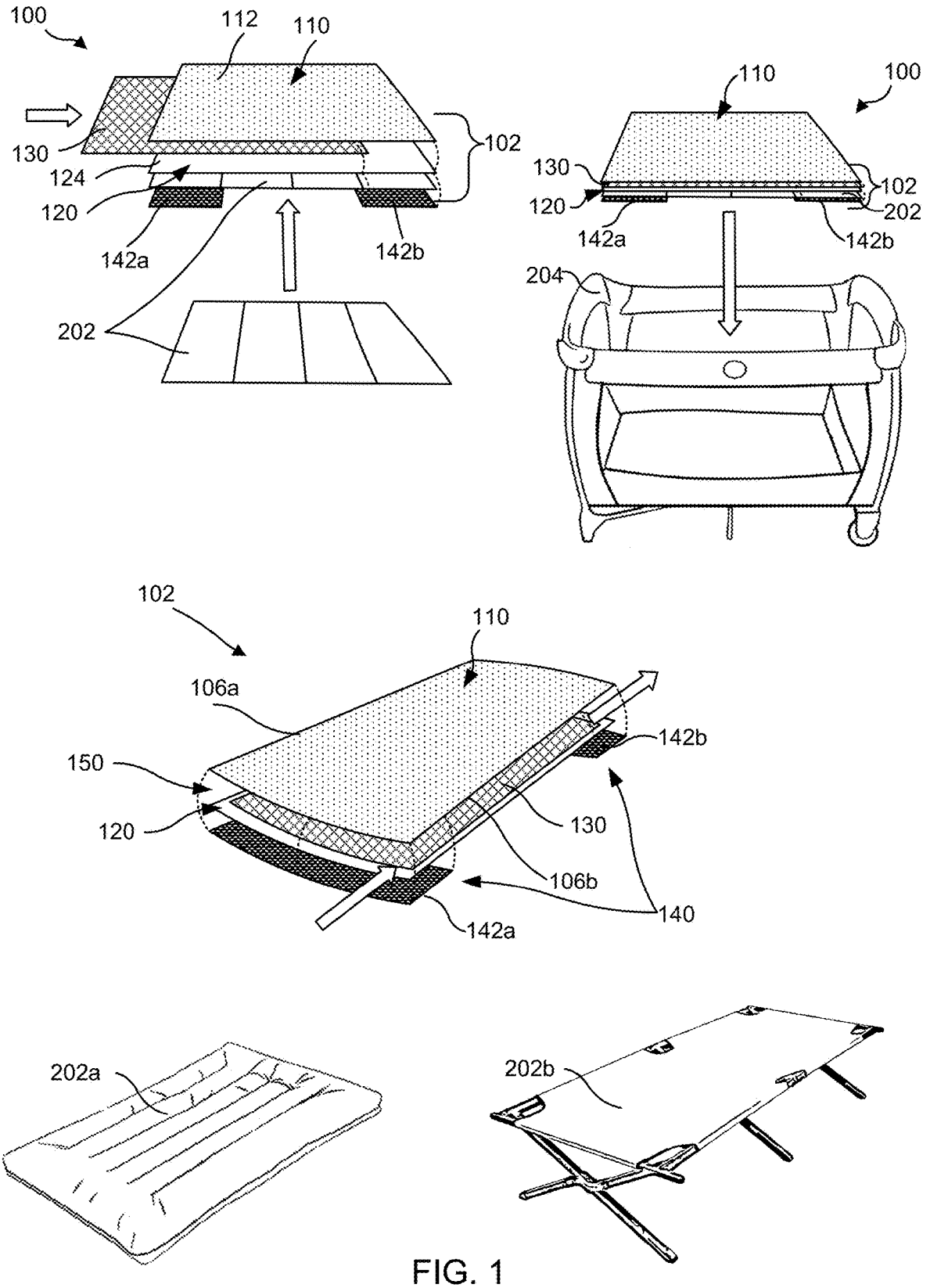
FIG. 1 is schematic block diagram a with a multilayer textile assembly and selected sleep platform environments, according to one or more examples of the present disclosure.

FIG. 1 is schematic block diagram of a system 100 with a multilayer textile assembly 102 and selected sleep platform environments, according to one or more examples of the present disclosure.

The upper left portion of FIG. 1 illustrates a system 100 including an apparatus for adjustably covering a sleeping platform 202. The apparatus includes a multilayer textile assembly 102 having a longitudinal axis and a transverse axis for conformingly coupling to the transportable sleeping platform 202. The multilayer textile assembly 102 includes a first textile layer 110 having a first textile piece with a contact surface 112 that faces away from the transportable sleeping platform 202 during usage for sleeping and sleeve top surface 114, or inner side of the first textile layer 110, opposite the contact surface 112. The multilayer textile assembly 102 having a second textile layer 120 comprising a second textile piece with a sleeve bottom surface 124 that faces away from the transportable sleeping platform 202 when covering the transportable sleeping platform 202, and a moisture barrier surface 122 that faces toward the transportable sleeping platform 202 when covering the transportable sleeping platform 202, where: two longitudinal edges of the second textile layer 120 are respective coupled to two longitudinal edges of the first textile layer 110 to form a sleeve 150 for receiving a third textile layer 130, when present, through one or more sleeve openings 152 between one or both transverse edges of the sleeve top surface 114 and the sleeve bottom surface 124 and the second textile layer 120 is shorter longitudinally than the first textile layer 110.

The multilayer textile assembly 102 further includes a fourth textile layer 140 comprising one or more envelope enclosures 142*a*, 142*b* configured to foldably enclose the one or more sleeve openings 152 along one or both of the transverse edges of the sleeve 150 formed between the first textile layer 110 and the second textile layer 120. In various examples, a sleeve 150 include openings at a first transversal end and at a second transversal end to facilitate insertion of the selectively insertable padding layer through a first opening of the sleeve at the first transversal end. Including opening are opposite end may also facilitate adjustment or removal of the selectively insertable padding layer through a second opening of the sleeve at the second transversal end.

The upper right portion of FIG. 1 further illustrates system 100 which also includes a support structure 204 for sleep platform 202. As previously explained, the multilayer textile assembly 102 is comprised of various textile layers, e.g. a first textile layer 110, a second textile layer 120, a removable third textile layer 130, and a fourth textile layer 140 comprising one or more envelope enclosures 142*a*, 142*b*. The construction of the multilayer textile assembly 102 is described in further detail below. For the system 100, the transportable sleep platform 202 is secured within the envelope enclosures 142*a* and 142*b*. Once the sleep platform 202 is secured within the envelope enclosures 142*a*, 142*b* the sleep platform 202 is added to the support structure 204. As shown in the upper right portion of FIG. 1, the sleep platform 202 and support structure 204 combine to form, in some examples, a portable infant, or toddler, playpen and or crib.

In various examples, the one or more envelope enclosures formed by the fourth textile layer secure the assembly without the need for elastics or zippers, eliminating potential choking hazards while providing an aesthetically pleasing and easy-to-use design. By contrast, many existing linens rely heavily on elastics or zippers, which are less versatile and pose additional risks. Furthermore, the inward-facing surfaces of the sleeve incorporate textured materials to minimize slippage of the insertable third layer, ensuring stability during use.

It is noted that the sleep platform 202 and support structure 204 are not limited to the illustration of the upper right portion of FIG. 1. As shown by the lower left and right portions of FIG. 1, the transportable sleep platform 202 may be an inflatable mattress 202*a*, a cot 202*b*, or any variety of transportable sleep platforms. In some examples, the transportable sleeping platform is configured for camping outside of a vehicle. In certain examples, a support structure 204 may be any support used with a transportable sleep platform 202, e.g. a frame and set of planks, a foldable stand, an inflatable stand, or a cot that fits a small mattress or pad.

According to one example, as shown in more detail in the middle schematic of FIG. 1, a multilayered textile assembly 102 for a transportable sleeping platform 202 includes a first textile layer 110, a second textile layer 120, a removable third textile layer 130, and a fourth textile layer 140 comprising one or more envelope enclosures 142*a*, 142*b*. The first textile layer 110 has two longitudinal edges and two transversal edges. The second textile layer 120 has two longitudinal edges and two transversal edges. The first textile layer 110 and the second textile layer 120 are coupled together along the respective longitudinal edges 106*a*, 106*b* b to form a sleeve 150 for receiving a third textile layer 130. In one or more examples, the sleeve 150 has two openings, one on each of the transversal edges 104*a*, 104*b* of the first and second textile edges, 110 and 120 respectively. In certain examples, the sleeve 150 has one opening along the transversal edges of the first textile layer 110 and the second textile layer 120. The fourth textile layer 140 comprising one of more envelope enclosures 142*a*, 142*b*, foldably enclose the sleeve openings 152 along the transverse edges of the sleeve 150 formed by the first textile layer 110 and the second textile layer 120. A third textile layer 130 is selectively inserted into the sleeve 150.

In some examples, the first textile layer 110, second textile layer 120, third textile layer 130, and fourth textile layer 140 are selected based on characteristics such as softness, drape, texture, finish (aesthetics), physical weight, durability, thickness, breathability, and/or moisture wicking. In various examples, one or more of the textile layers (110, 120, 130, 140 respectively) are made of a cooling material to promote air flow. In certain examples, the textile layers are made of moisture wicking materials which direct moisture towards a transportable sleeping platform 202. In some examples, the textile layers are made of insulating materials to reduce the rate of heat transfer in the direction towards the transportable sleeping platform 202. In various examples, the textile layers are of a thermoregulating materials such as cotton, natural wool, synthetic wool, natural latex, bamboo-derived viscose, synthetic performance fabric, and combinations thereof. In some examples, each textile layer utilizes a selected material to achieve a desired result for the. In other examples, each textile layer is made of the same material but the layers varying in thickness to produce the desired characteristics for the multilayer textile assembly 102 for a particular application or user.

The disclosed system 100 introduces a versatile multilayer textile assembly for covering a sleep platform, offering innovative features that address safety, comfort, and adaptability shortcomings in existing products such as fitted sheets, mattress pads, and zippered covers. The multilayer structure includes a first textile layer for user contact, a second layer incorporating moisture-barrier properties, and a selectively insertable third layer for padding or absorbency. Unlike existing linens, the third layer is selectively configured for specific user and/or environmental circumstances, such as for example, omitting padding for infants to mitigate suffocation risks or adjusting thickness for elderly individuals requiring pressure relief. These features offer modular functionality that is absent in existing systems, enhancing both utility and safety across diverse user groups.

Figure 2:
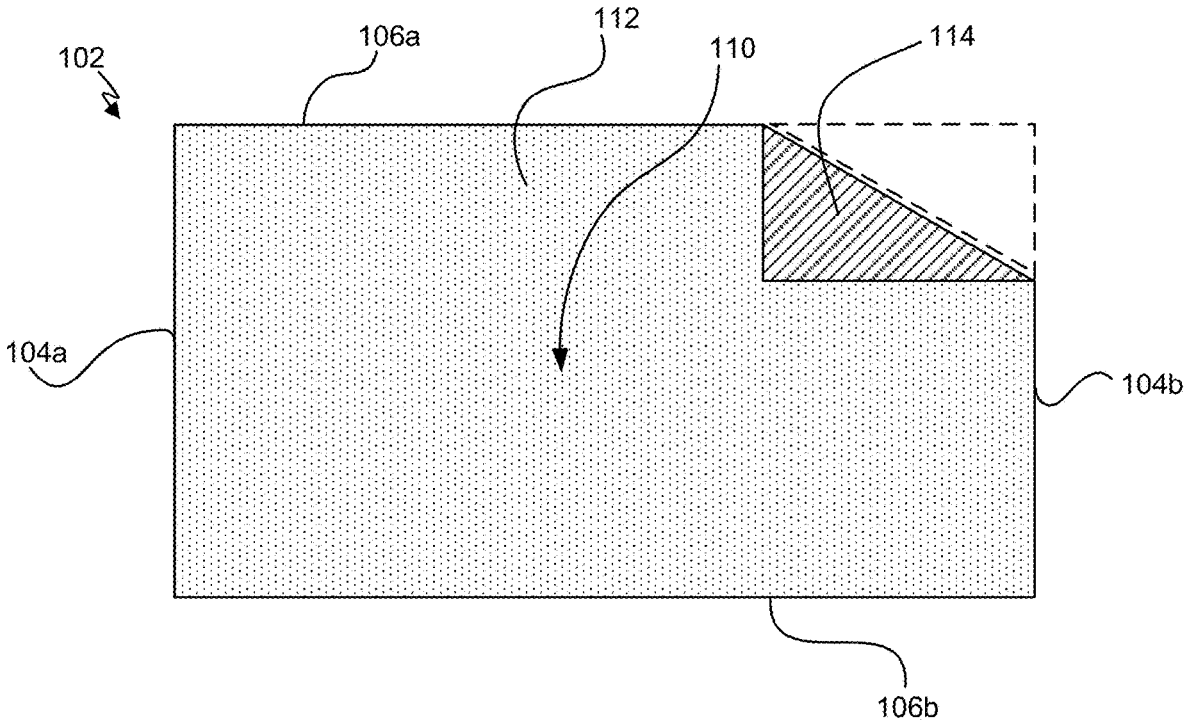
FIG. 2 a top view of a multilayer textile assembly, according to one or more examples of the present disclosure.
Figure 3:
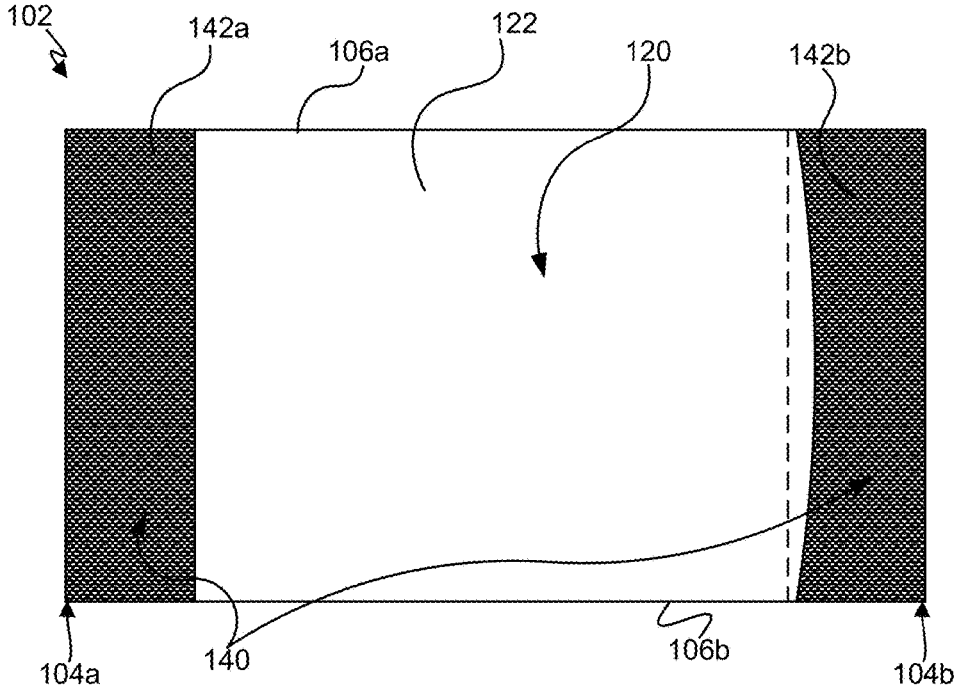
FIG. 3 is a bottom view of the multilayer textile assembly of FIG. 2, according to one or more examples of the present disclosure.

FIG. 2 is a top view of a multilayer textile assembly 102, according to one or more examples of the present disclosure. FIG. 3 is a bottom view of the multilayer textile assembly 102 of FIG. 2, according to one or more examples of the present disclosure.

In various examples, the first textile layer 110 is the outermost layer of the multilayer textile assembly 102. In such examples, the first textile layer 110 has a contact surface 112 that faces away from the transportable sleeping platform during usage for sleeping and a sleeve top surface opposite the contact surface 112. In some examples, the first textile layer 110 is soft, durable material. In some examples, the first textile layer 110 is a double-brushed flannel such both the outward-facing surface and the sleeve top surface 114 have the same texture. In certain examples, the first textile layer 110 has a contact surface 112 is a soft material and the sleeve top surface 114 is texturized. In certain examples, at least one inward-facing surface of the sleeve 150 includes a friction-enhancing textured material to minimize slippage of the third textile layer 130 within the sleeve 150. In other words, the textured sleeve top surface 114 provides a friction factor for inside the sleeve 150, where the friction forces of the textured sleeve top surface 114 and the third textile layer 130 to minimize slipping of the third textile layer 130 within the sleeve 150.

In one or more examples, the second textile layer 120 comprises one or more of the following: polyurethane laminate (PUL), thermoplastic polyurethane (TPU), organic or non-organic cotton with TPU film, microfiber, nylon, air-jet textured nylon or polyester fabric (e.g., Taslan® or similar), waterproof breathable membrane (e.g., Gore-Tex® or similar) cotton, wool, or other suitable fabrics. "Taslan® is a registered trademark of Invista, and Gore-Tex® is a registered trademark of W. L. Gore & Associates, Inc. These trademarks are referenced solely for descriptive purposes and do not imply endorsement.

Material selection further distinguishes this system from conventional products. The disclosed assembly employs advanced textiles such as Gore-Tex®, Taslan®, bamboo-derived viscose, and other thermoregulating or moisture-wicking materials. These materials allow the system to adapt to different environmental conditions, promoting cooling or insulating effects based on the user's needs. For example, the first and second textile layers may be selected for their breathability or waterproofing properties, making the system suitable for both indoor and outdoor environments. Existing systems lack this level of material configuration and selectability, which optimizes user comfort and hygiene under various environments that can change over time or with a particular application.

In some examples, the second textile layer 120 is made of a composite of the different materials previously listed. In some examples, the second textile layer 120 is selected to be texturized to enhance friction on both sides of the textile layer, e.g. the sleeve bottom surface 124 and the moisture barrier surface 122 that faces toward the sleeping platform 202. In some examples, the moisture barrier surface 122, which faces towards the sleeping platform 202, prevents unwanted moisture from coming in contact with the sleeping platform 202.

In various examples, the third textile layer 130 is a selectively insertable layer for the multilayer textile assembly 102. In some examples, the third textile layer 130 includes a variable thickness. The variable thickness may be made of padding materials such as foam, cotton padding, insulation padding, and inflatable padding. The thickness of the third textile layer 130 is selected based on the user's needs. In one or more examples, the third textile layer 130 is a relatively thin layer, less than 20 mm of thickness. In certain examples, the third textile layer 130 has a thickness of approximately 10 mm to 30 mm. In yet another example, the third textile layer 130 is relatively thick, having a thickness of more than 30 mm. The varying thicknesses serve multiple purposes, for example, a relatively thick third textile layer 130 may be selected for a user looking for an additional padding for the transportable sleeping platform 202. In other examples, the third textile layer 130 is removed completely for an infant to use the multilayer textile assembly 102. The third textile layer 130 would be removed to prevent suffocation and promote proper infant sleeping positions since an inserted third textile layer 130 would pose a potential suffocation risk for an infant user. In some examples, the third textile layer 130 is selected based on absorbency characteristics of the material. In some examples, the third textile layer 130 is an absorbent pad designed to soak up liquids. In at least some examples, the third textile layer 130 is composed of multiple material layers to allow for liquid absorption and at least one layer provides a waterproof backing. In some examples, the third textile layer 130 is a disposable absorbent pad. In other examples, the third textile layer 130 is a reusable or washable absorbent pad.

The first and second textile layers 110, 120 are coupled together to form a sleeve 150, where the top portion of the sleeve is the sleeve top surface 114 of the first textile layer 110 and the sleeve bottom surface is a part of the second textile layer 120. The sleeve 150 has at least one opening 152 to permit a selectively insertable third textile layer 130. The sleeve 150 is enclosed by the foldable envelope enclosures 142*a*, 142*b* of the fourth textile layer 140. In one or more examples, the first and second textile layers 110, 120, are coupled along their respective longitudinal edges 106*a-b* and are not coupled along their transversed edges 104*a-b* to form two openings 152 for the sleeve 150. In various examples, the third textile layer 130 can be pulled into the sleeve 150 from one opening 152 to the other, as shown by the arrows in the elongated multilayer textile assembly 102 of the middle portion of FIG. 1. In one or more examples, the first and second textile layers 110, 120, are coupled along their respective longitudinal edges 106*a-b* and one transverse edge 104*a* to form a singular opening 152 for the sleeve 150. In yet another example, the first and second textile layers 110, 120, are coupled along their respective longitudinal edges 106*a*, 106*b* and are not fully coupled along their transversal edges 104*a*, 104*b* such that there is still at least an open portion of the transversal edges 104*a*, 104*b* to form an opening 152 for the sleeve 150.

The fourth textile layer 140 includes at least one envelope enclosure 142*a* and/or 142*b*. As shown in at least FIG. 3 and the multilayer textile assembly 102 of the middle portion of FIG. 1, the fourth textile layer 140 comprises two envelope enclosures 142*a* and 142*b* respectively. The envelope enclosures 142*a*, 142*b* are located along the transverse edges of the first textile layer 110. In some examples, the envelope enclosures 142*a*, 142*b* are coupled the longitudinal edges of the first and second textile layers 110, 120. In certain examples, the envelope enclosures 142*a*, 142*b*, are further coupled to the transverse edges of the first textile layer 110. The envelope enclosures 142*a*, 142*b*, of the fourth textile layer 140 are configured to fold over and enclose the at least one sleeve opening 152 along the transverse edges of the multilayer textile assembly 102. In some examples, the fourth textile layer 140 is made of a different material than the first textile layer 110. In some examples, the first textile layer 110 is made of a material having some stretch and the envelope enclosures 142*a*, 142*b* of the fourth textile layer 140 are made of a material having little to no stretch.

In certain examples, the first textile layer 110 is a material with little to no stretch and the envelope enclosures 142*a*, 142*b* are of a material with some stretch in the material to adapt to the sleeping platform 202. In certain examples, the fourth textile layer 140 is the same material as the first textile layer 110. In yet another example, the fourth textile layer 140 is a continuation of the first textile layer 110, such that the first textile layer 110 is longitudinally longer than the second textile layer 120 and the fourth textile layer 140 is formed by the transverse ends of the first textile layer 110 are folded over the second textile layer 120 and form the envelope enclosures 142*a*, 142*b*. In some examples, the fourth textile layer 140 has a distinct aesthetic pattern and the first textile layer 110 has a different distinct aesthetic pattern such that a user can readily see the difference in the textile layers of the multilayer textile assembly 102. In other examples, the aesthetic patterns of the first textile layer 110 and the fourth textile layer 140 envelope enclosures 142*a*, 142*b* may be a difference in color, pattern, or visible textures.

Figure 4A:
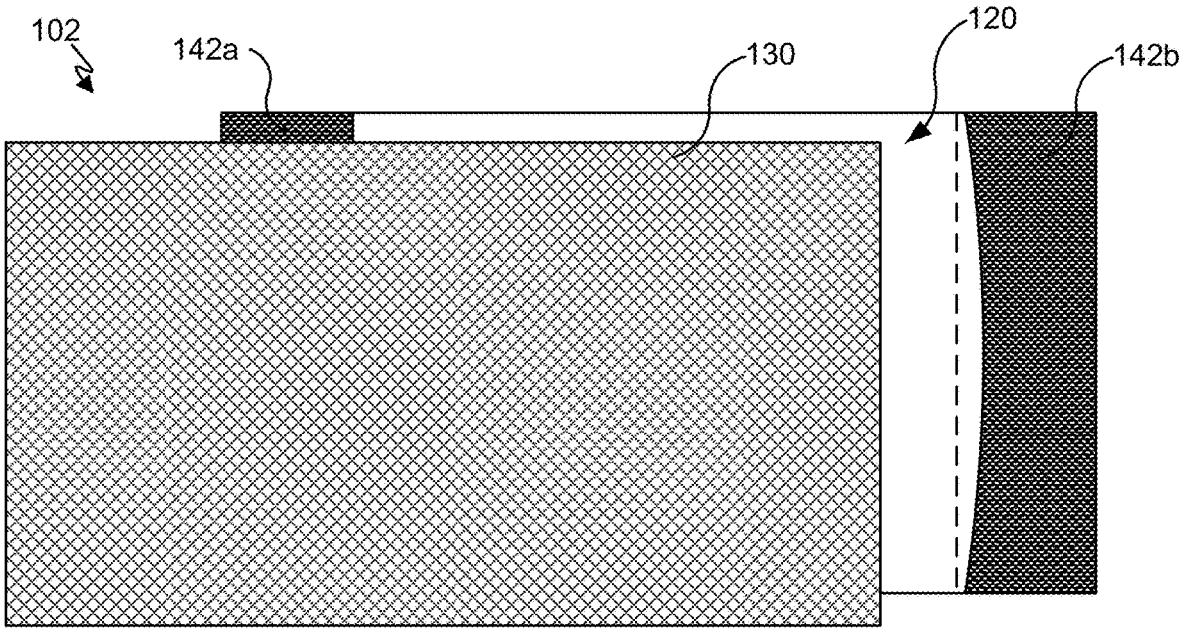
FIG. 4A is a bottom view of a multilayer textile assembly with a third layer being a selectively removable padding layer, according to one or more examples of the present disclosure.
Figure 4B:
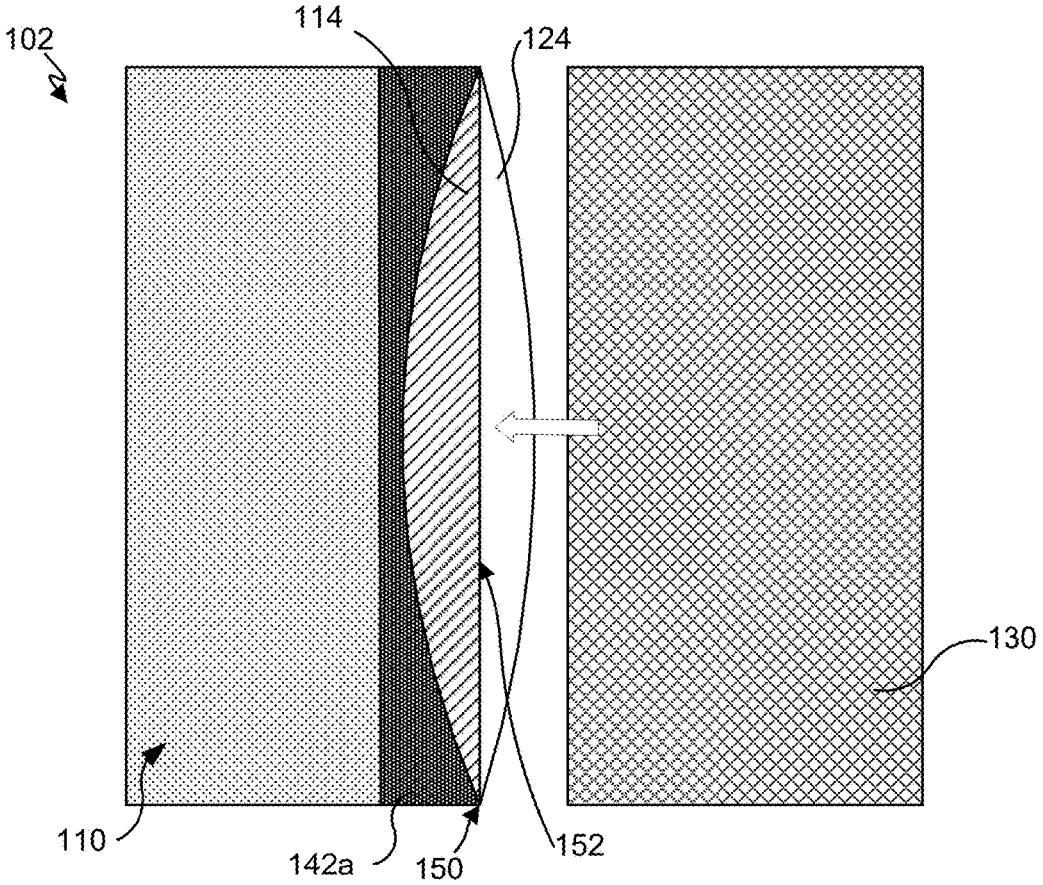
FIG. 4B is a side view of the insertion of a selectively insertable padding layer into the multilayer textile assembly FIG. 4A, according to one or more examples of the present disclosure.

FIG. 4A is a bottom view of a multilayer textile assembly 102 according to one or more examples of the present disclosure. FIG. 4B is a side view of the insertion of a third textile layer 130 made of padding in the multilayer textile assembly 102 of FIG. 4A, according to one or more examples of the present disclosure.

FIGS. 4A-B illustrate insertion of a third textile layer 130 into a multilayer textile assembly 102. As shown in FIG. 4B, the third textile layer 130 is inserted into the sleeve 150, formed by the top sleeve surface 114 of the first textile layer 110 and the sleeve bottom surface 124 of the second textile layer 120. Once the third textile layer 130 is inserted within the sleeve 150, the at least one envelope enclosure 142*a* and/or 142*b* is folded over the sleeve 150 to prevent the third textile layer 130 from slipping out of the multilayer textile assembly 102. In some examples, the third textile layer 130 is adjustable by pulling the third textile layer 130 from either opening 152 of the sleeve 150, as shown in the middle schematic of FIG. 1 illustrating a multilayer textile assembly 102. In other examples, the third textile layer 130 is inserted by progressively pushing or sliding the third textile layer 130 into the sleeve 150 while maintaining exterior alignment and ensuring each corner of the third textile layer 130 is fully positioned within the sleeve 150. In some rare examples, the third textile layer 130 may be used in place of a sleep platform 202 and would be secured as described herein.

According to at least one example, as shown in the upper left and right portions of FIG. 1, a system 100 of a multilayer adjustable sleep platform covering includes a multilayer textile assembly 102, a sleeping platform 202, and a support structure 204 for the sleeping platform 202. In one or more examples, the sleeping platform 202 is a multi-paneled platform, such as those found in infant cribs and requires an external support structure 204, e.g., an infant crib or play structure such as a playpen or play yard. In other examples, the sleeping platform 202 can be an inflatable mattress 202*a* or a cot 202*b*, as shown in lower schematics of FIG. 1. In some examples, the system 100 of a multilayer textile assembly 102 is used for the outdoors and camping wherein the sleep platform 202 may be a foam pad and/or air mattress. In some examples of outdoor use systems, the multilayer textile assembly 102 will utilize textile layers such as nylon or materials that are waterproof and/or easy to clean quickly.

The sleeping platform 202 can be any platform that user would use to sleep upon. Some additional examples of sleeping platform 202 include a recreational vehicle (RV) bed, a multi-paneled foam bed, a thick layer of foam, and other transportable sleeping platforms. In some examples, the sleeping platform 202 is not limited to human users, rather the sleeping platform 202 can include animal pet beds, pet kennel platforms, and pet kennel inserts.

Additionally, the support structure 204 will vary based on the sleeping platform 202. In some examples, a support structure 204 is not necessary, such as a cot 202*b*, as shown in the lower right portion of FIG. 1. Many of the examples described herein are for a sleeping platform system 100, although it is noted that the multilayer textile assembly 102 may be used in a variety of alternative non-sleeping systems. For example, a multilayer textile assembly 102 could be used as a tablecloth for a foldable table or a picnic table. Additionally, a multilayer textile assembly 102 could be used on a bench or bleacher.

Figure 5A:
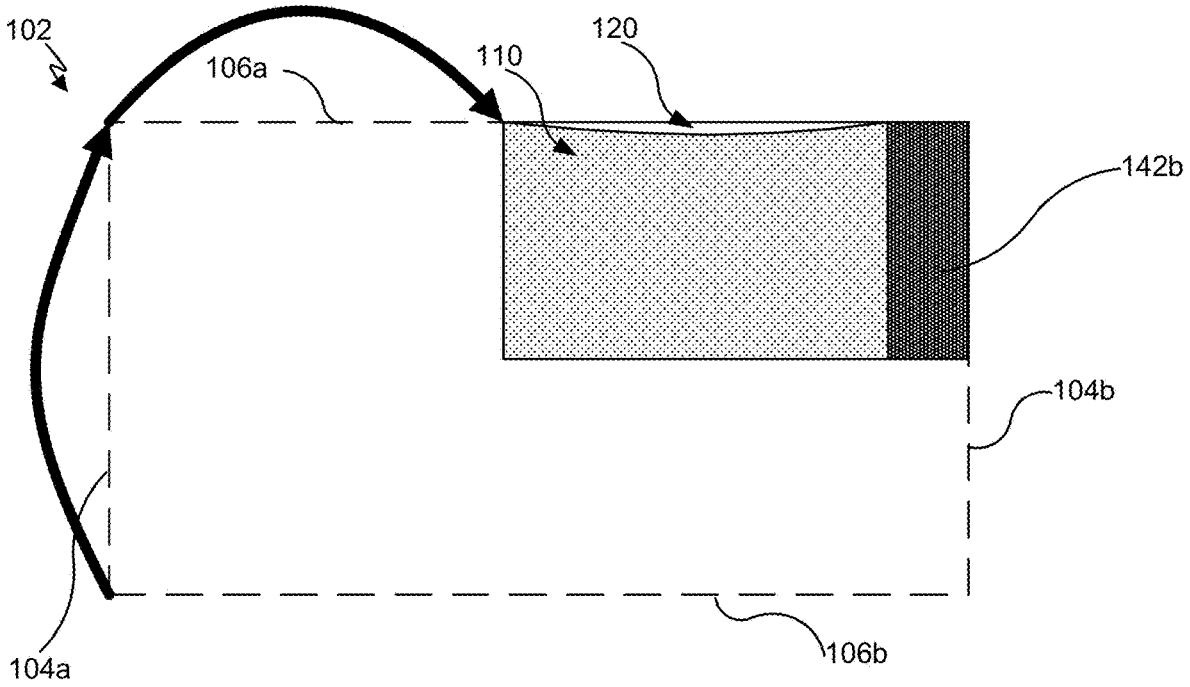
FIG. 5A is an illustration of a method of folding multilayer textile assembly, according to one or more examples of the present disclosure.
Figure 5B:
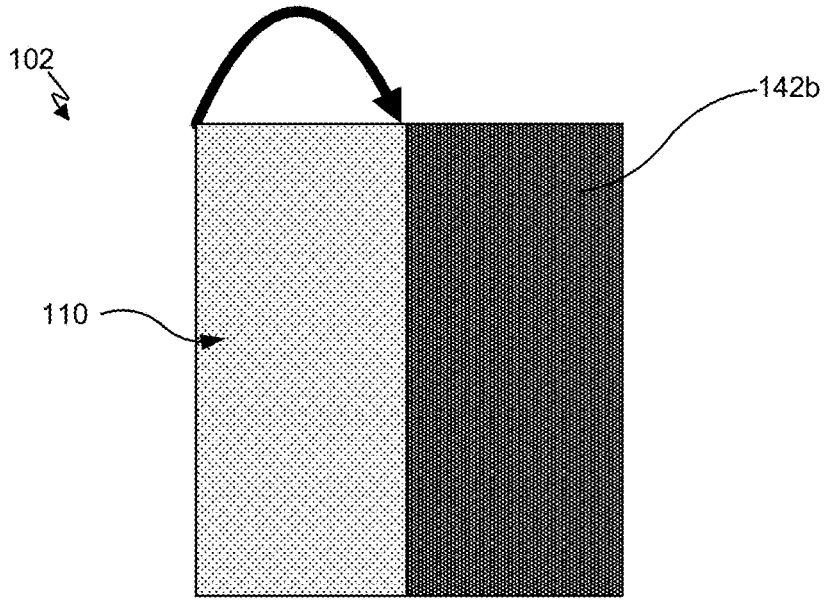
FIG. 5B is a method of folding the multilayer textile assembly of FIG. 5A into a pillow or cushion shape, according to one or more examples of the present disclosure.

FIG. 5A is an illustration of a method of folding a multilayer textile assembly 102, according to one or more examples of the present disclosure. FIG. 5B is a method of folding a multilayer textile assembly 102 of FIG. 5A into a pillow or cushion shape, according to one or more examples of the present disclosure.

As shown in FIGS. 5A-B, the multilayer textile assembly 102 can be folded into a pillow or cushion when not in use. In some examples, to fold into a pillow or cushion, the multilayer textile assembly 102 is folded into at least a quarter of its initial size, as shown in FIG. 4A, before being folded at least once more and secured within one of the envelope enclosures 142*b*. The pillow or cushion is folded such that the exterior layer will be the first textile layer 110 and one of the envelope enclosures 142*b* while the second textile layer 120 and third textile layer 130, if present, form the inner padding of the pillow or cushion. Additional folding of the textile layers may be necessary depending on the multilayer textile assembly 102 size and the desired pillow or cushion size. To secure the pillow or cushion shape, one of the envelope enclosures 142*b* of the fourth textile layer 140 folded over the other remaining textile layers, 110, 120, and 130.

In various examples, the folding functionality of the multilayer textile assembly 102 enabling conversion into a pillow or cushion, adds a layer of versatility absent in existing systems. This unique capability addresses practical storage and portability needs for users.

Figure 6A:
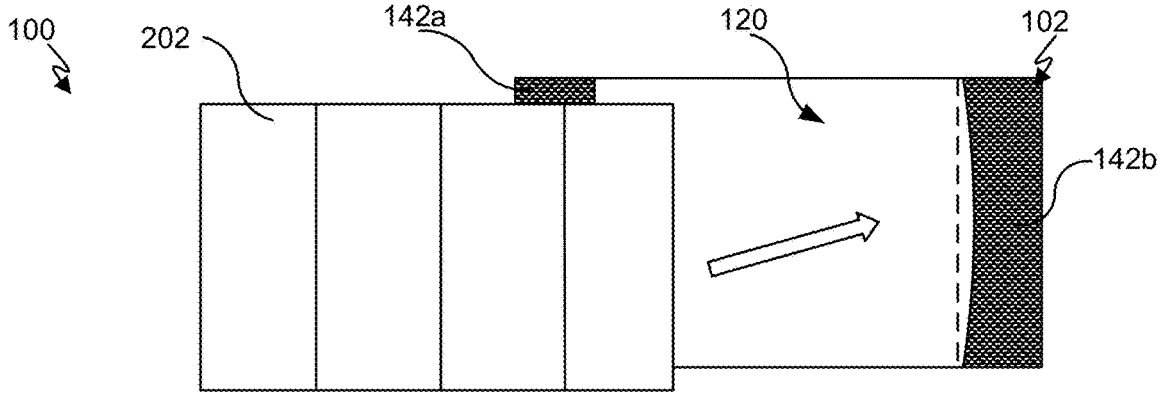
FIG. 6A depicts an assembly step involving the system of FIG. 1, according to one or more examples of the present disclosure.
Figure 6B:
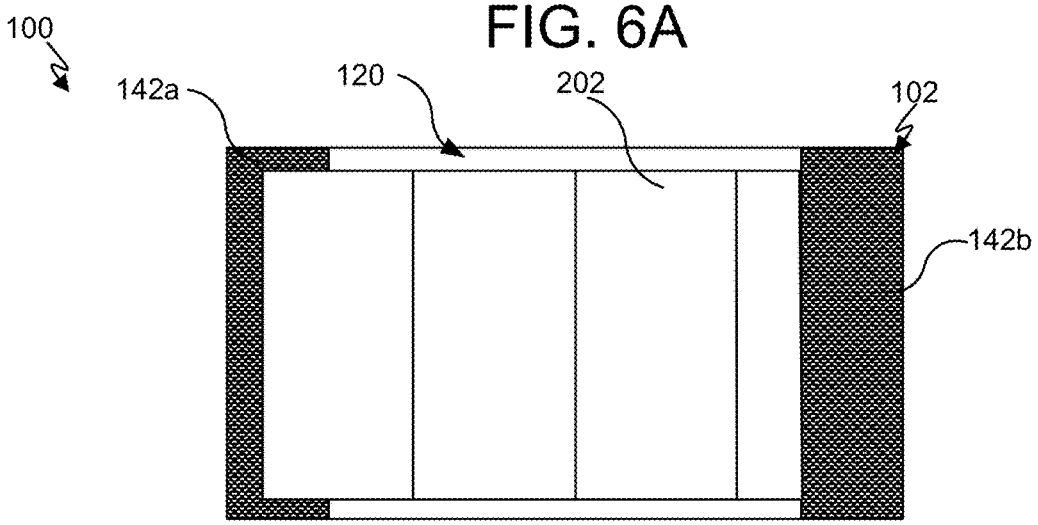
FIG. 6B depicts an assembly step involving the multilayer textile assembly of FIG. 1, according to one or more examples of the present disclosure.
Figure 6C:
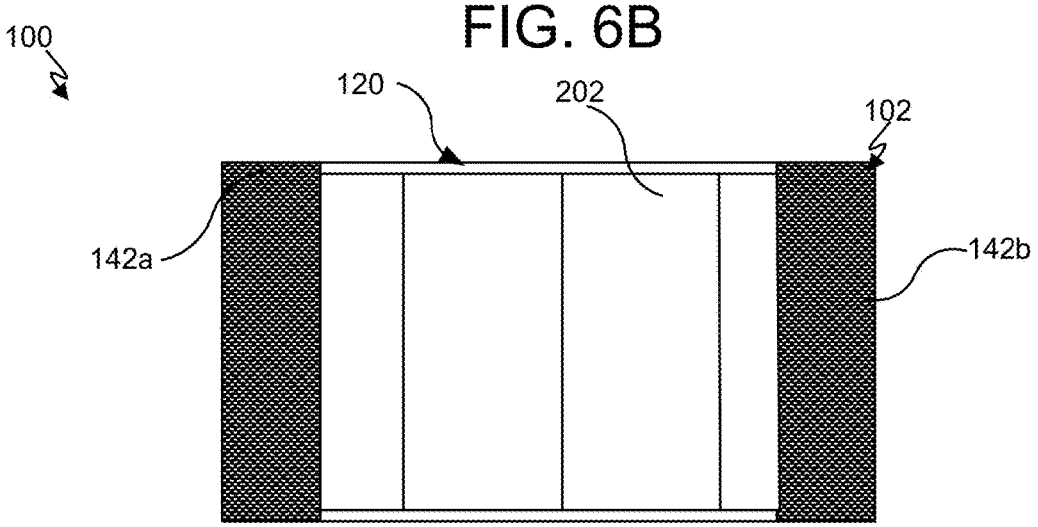
FIG. 6C depicts another assembly step involving the multilayer textile assembly of FIG. 1, according to one or more examples of the present disclosure.
Figure 7:
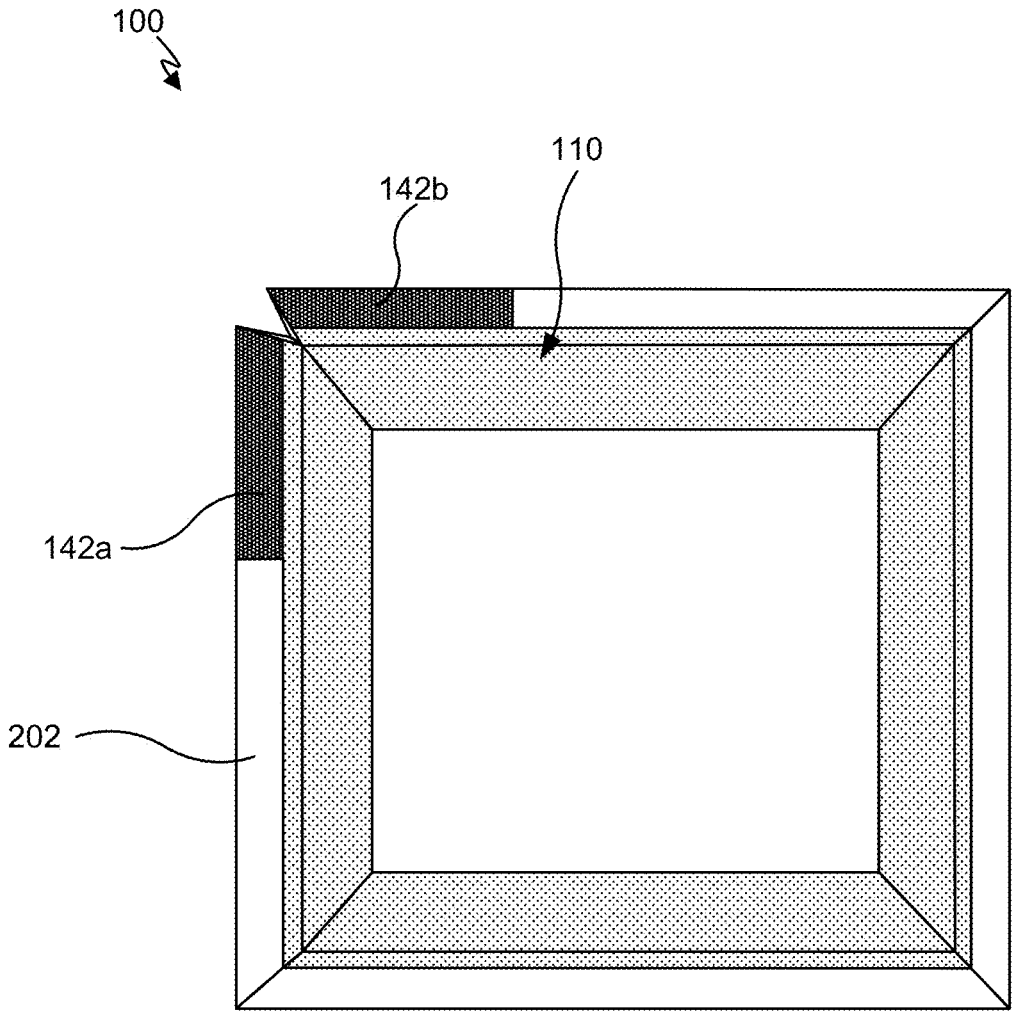
FIG. 7 depicts a further assembly step involving the multilayer textile assembly of FIG. 1, according to one or more examples of the present disclosure.

FIG. 6A is a step of assembly of the upper systems of FIG. 1, according to one or more examples of the present disclosure. FIG. 6B is step of the system 100 of use of a versatile multilayer textile assembly 102 for covering a sleep platform, according to one or more examples of the present disclosure. FIG. 6C is step of assembly of the system 100 of use of a versatile multilayer textile assembly 102 of FIG. 1 for covering a transportable sleep platform. FIG. 7 depicts assembly of the system 100 of the use of the multilayer adjustable sleep platform textile assembly 102 of FIG. 1, according to one or more examples of the present disclosure.

FIGS. 6A-C illustrate an assembly of the system 100 with a versatile multilayer textile assembly for covering a sleep platform according to one or more examples of the present disclosure. The depicted implementation of system 100 includes an infant crib or playpen support structure 204 and a multi-paneled sleep platform 202. The platform 202 is first inserted into envelope enclosure 142*b*. Once secured by envelope enclosure 142*b*, as shown in FIG. 6B, the sleep platform 202 is inserted into envelope enclosure 142*a*. A fully secured platform 202 is shown in FIG. 6C, having the sleep platform 202 be flat and the envelope enclosures 142*a*, 142*b* fit snuggly around the transverse edges of the sleep platform 202. Additionally, the sleep platform 202 is in contact with the moisture barrier surface 124 of the second textile layer 120. In some examples, the multilayer textile assembly 102 is sized such that the sleep platform 202 can be folded for storage purposes without removing the multilayer textile assembly 102, as shown in FIG. 7. The ability of the multilayer textile assembly 102 to be stored with the sleep platform 202 makes the system 100 easier to store quickly and transport the system 100 from one location to another.

Figure 8A:
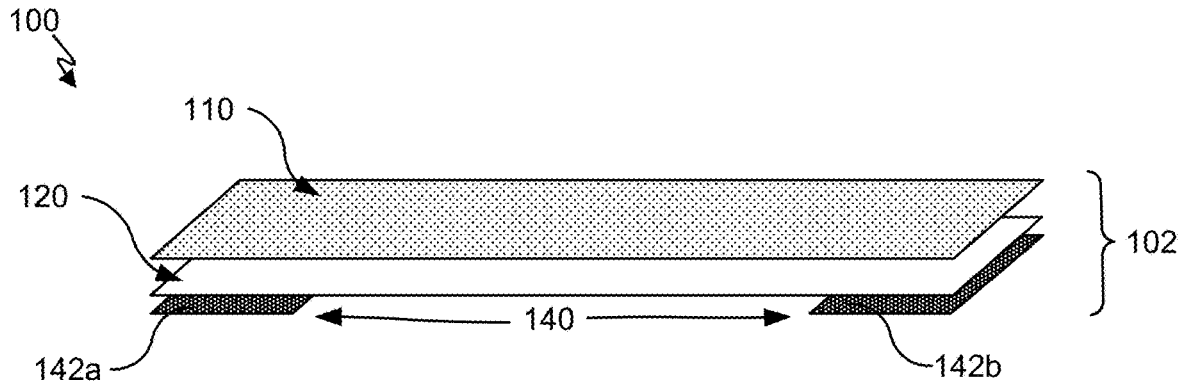
FIG. 8A depicts a cross-sectional view of the multilayer textile assembly of FIG. 1, in which a third textile layer of selectively insertable paddling is omitted, according to one or more examples of the present disclosure.
Figure 8B:
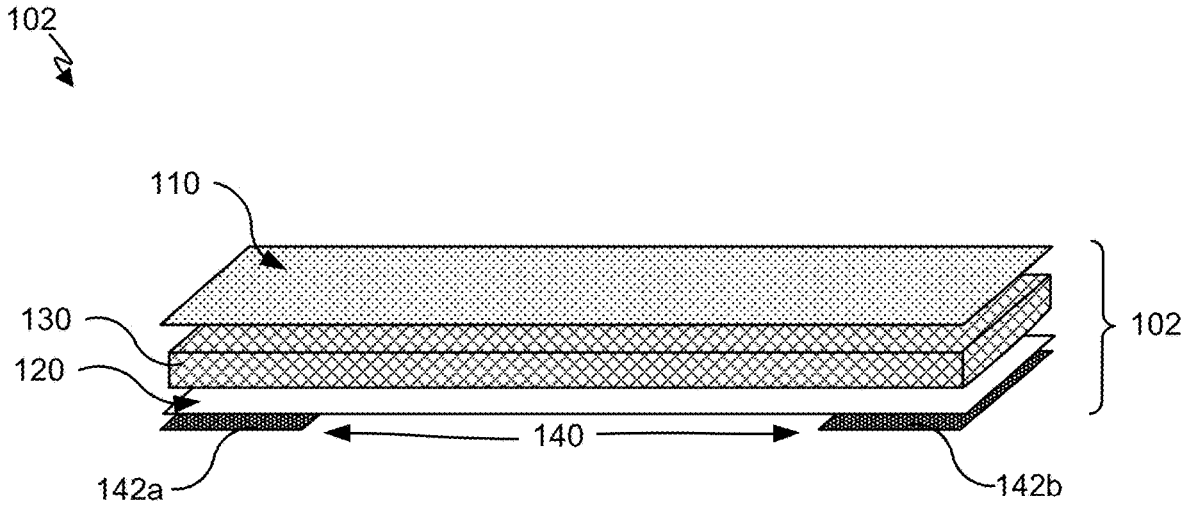
FIG. 8B depicts a cross-sectional view of the multilayer textile assembly of FIG. 1, in which a third textile layer of selectively insertable paddling has a predetermined thickness, according to one or more examples of the present disclosure.
Figure 8C:
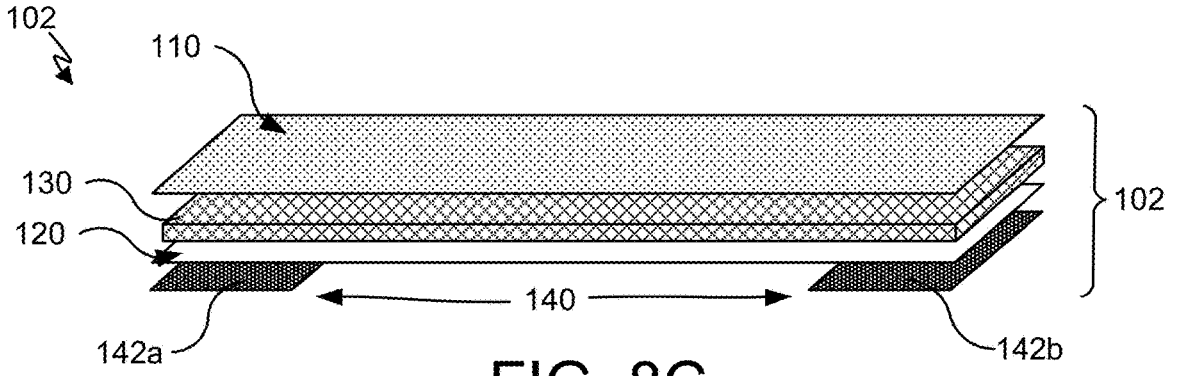
FIG. 8C depicts a cross-sectional view of the multilayer textile assembly of FIG. 1, in which a third textile layer of selectively insertable paddling has a lesser predetermined thickness than depicted in FIG. 8B, according to one or more examples of the present disclosure.

FIGS. 8A-C illustrate a system 100 with cross-sectional views of a multilayer textile assembly 102 having a third textile layer 130 that is a selectively insertable padding layer with a selectable thickness for accommodating the user with a set of predetermined body characteristics in a predetermined set of environmental conditions.

In certain implementations, the third textile layer which is the selectively insertable padding layer is omitted from being inserted in the sleeve for circumstances in which padding would pose a potential suffocation risk for the user when the user is an infant or another person at risk for suffocation during sleep.

In one or more implementations the third textile layer 130 comprising the selectively insertable padding layer has a selectable thickness for accommodating a user with a set of predetermined body characteristics in a predetermined set of environmental conditions. In some examples, the predetermined body characteristics may include characteristics such as body temperature regulation needs, age, body weight and size and pressure distribution, sensitivity to pressure points (e.g., bony prominences), presence of specific health conditions.

For young users (e.g., infants and toddlers) and the very old (elderly or physically delicate individuals), certain health conditions and physical characteristics may be most beneficially affected by the appropriate thickness of padding. Here are some examples:

For young users, examples of specific health conditions may include prevention of suffocation risks. For example, selectively inserting a third textile layer 130 with thin or no padding can help reduce the risk of suffocation in infants, especially those under 12 months, as thick or soft padding may pose a hazard. For users at risk for positional plagiocephaly or flat head syndrome, moderate padding with pressure-relieving properties can support the head and reduce uneven pressure on the skull. For users still growing at a rapid rate, support for developing bones can be advantageous. Specifically, providing a third textile layer 130 that uses padding with a soft but firm consistency can provide support for growing spines and joints without being too soft to compromise safety. Moreover, using a padding thickness that allows for proper airflow and moisture-wicking can help prevent skin irritation or respiratory issues in infants sensitive to allergens or damp environments.

For elderly users, the portable sleeping platform may be a mattress for home use adjustable bed. In such examples, thicker padding with pressure redistribution capabilities can prevent the formation of sores, especially in individuals who are bedridden or have limited mobility. Inserting a relatively thicker padding in the range of about 1-4 inches can cushion joints and reduce discomfort in elderly individuals with arthritis or other joint-related conditions. Thicker padding may help absorb shocks and minimize risks of bruising or fractures from minor impacts. Properly layered padding can provide spinal support and alleviate pain caused by degenerative disc disease or other spinal issues.

In some examples, elderly or delicate individuals may have a diminished ability to regulate body temperature. Padding that balances insulation and breathability can help maintain comfort.

FIG. 8A is an example of a multilayer textile assembly 102 where the third textile layer 130 is not present. FIG. 8B illustrates a multilayer textile assembly 102 having a relatively thick third textile layer 130 which can increase the padding within the multilayer textile assembly 102. The third textile layer 130 is located within the sleeve 150 made from the sleeve top surface 114 of the first textile layer 110 and sleeve bottom surface 124 of the second textile layer 120. FIG. 8C illustrates a multilayer textile assembly 102 having a moderately thick third textile layer 130. Similar to FIG. 8B, the third textile layer 130 is located within the sleeve 150 made from the sleeve top surface 114 on the lower face of the first textile layer 110 and the sleeve bottom surface 124 on the upper face of the second textile layer 120, where "upper" and "lower" refer to the orientation as depicted in the drawings and should not be interpreted as directional limitations.

Figure 9A:
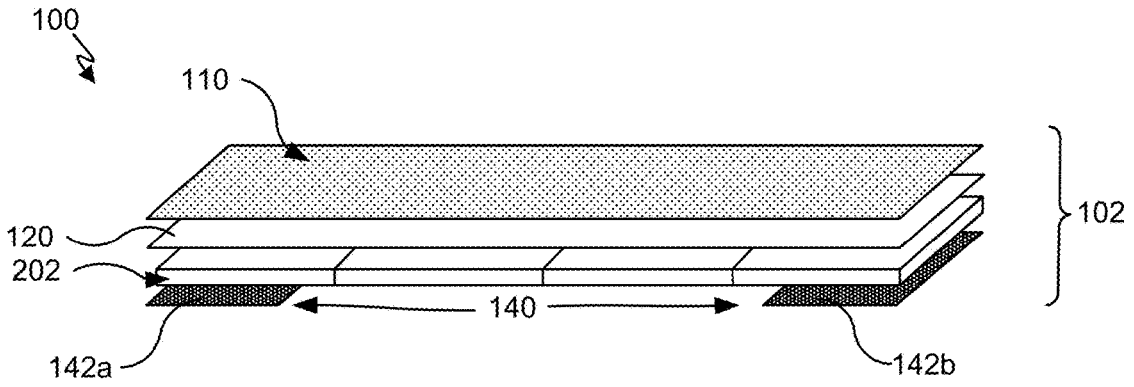
FIG. 9A depicts a cross-sectional view of the multilayer textile assembly of FIG. 1, covering a thin sleep platform and in which a third textile layer of selectively insertable paddling is omitted, according to one or more examples of the present disclosure.
Figure 9B:
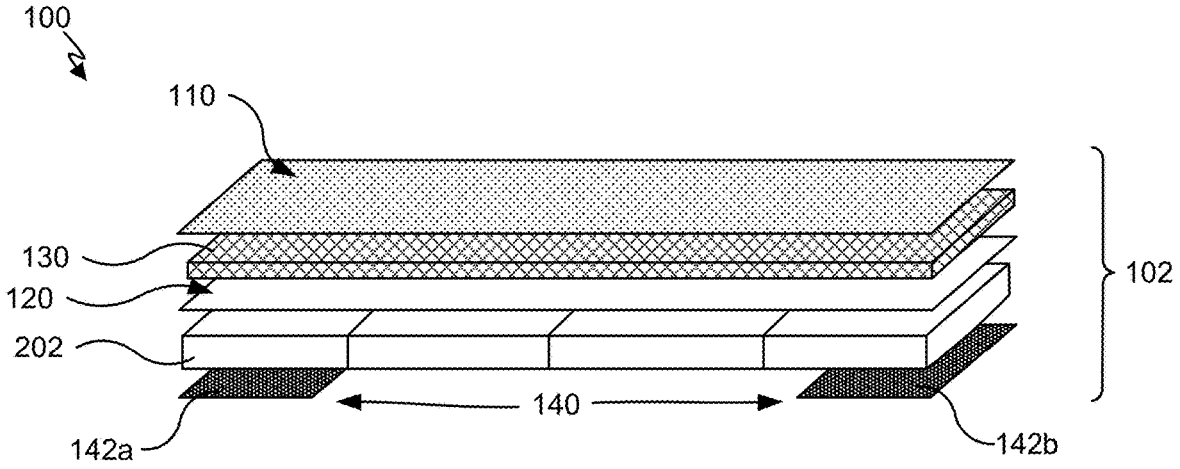
FIG. 9B depicts a cross-sectional view of the multilayer textile assembly of FIG. 1, covering a sleep platform that is relatively thicker than depicted in FIG. 9A and in which a third textile layer of selectively insertable paddling is inserted, according to one or more examples of the present disclosure.
Figure 9C:
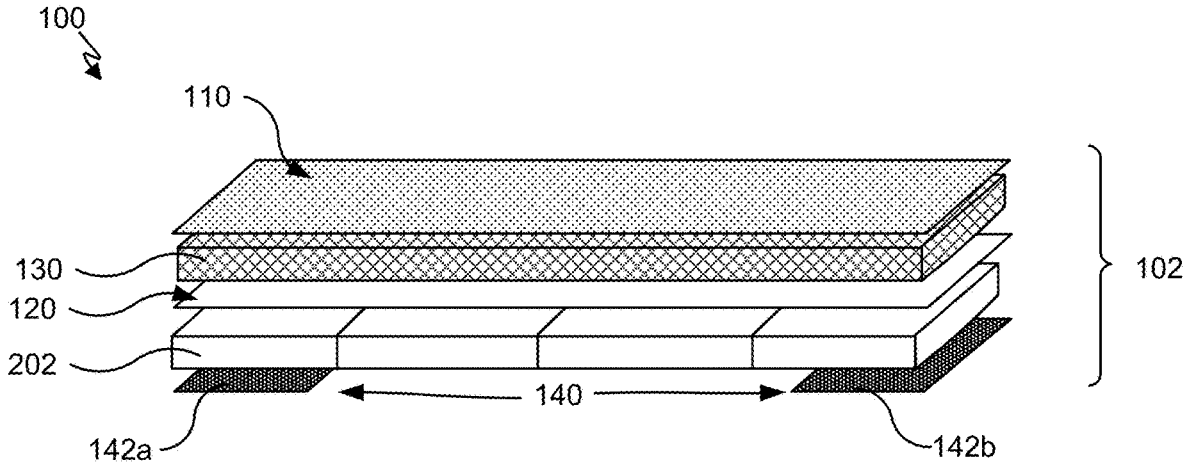
FIG. 9C depicts a cross-sectional view of the multilayer textile assembly of FIG. 1, covering a sleep platform that is relatively thicker than depicted in FIG. 9A and in which a third textile layer of selectively insertable paddling has a greater predetermined thickness than depicted in FIG. 9A, according to one or more examples of the present disclosure.

FIGS. 9A-9C depict a cross-sectional view of a system 100 with a multilayer textile assembly 102, according to one or more examples of the present disclosure. As shown in FIG. 9A, in certain implementations the third textile layer comprising the selectively insertable padding layer is omitted from being inserted in the sleeve for circumstances in which padding would pose a potential suffocation risk for the user when the user is an infant or another person at risk for suffocation during sleep. In some examples, the third textile layer 130, may be used with a relatively thick sleep platform 202. The sleep platform 202 is secured by the envelope enclosures 142*a* and 142*b*.

FIG. 9B, shows another implementation of the system 100 where the sleep platform 202 is relatively thin and is securable by the envelope enclosures 142*a* and 142*b*. FIG. 9C shows yet another example of a system 100 having a relatively thick sleeping platform 202. In FIG. 9C, the multilayer textile assembly 102 also includes a third textile layer 130. As shown in FIGS. 9A-9C, any number of combinations of sleeping platforms 202 may be used with any combination of selectively removable third textile layers 130.

Benefits of the multilayer textile assembly 102 include its wide array of uses. The multilayer textile assembly 102 can serve as a fitted covering for a sleep platform 202, provide an improved texture or surface to sleep on when using a sleep platform 202, a waterproof protector for sleep platforms 202, a surface covering which is easier to clean or wash than the sleep platform 202, and/or be folded into a pillow or cushion. The envelope enclosures 142*a*, 142*b* are easy to secure around a sleep platform 202 and remain in place without the need for extra elastics. The omission of extra elastics or straps can reduce a potential choking hazards for users of all ages. Additionally, the selectively insertable third textile layer 130 provides adjustable comfort for users by adding a layer 130 of padding for extra comfort and removing the third textile layer 130 when less padding is desired.

The adaptability of system 100 and the multilayer textile assembly 102 across a wide range of sleep platforms, including cribs, playpens, cots, RV beds, and inflatable mattresses, makes it particularly innovative. In some implementations, a modular construction enables users to easily transition the assembly between different platforms without sacrificing fit or functionality. FIGS. 1 and 9A, (B, 9C, illustrate this adaptability by showing the assembly in various configurations and environments. Additionally, the system is compatible with both sleeping and non-sleeping applications, such as serving as a protective table covering or picnic mat. This expanded utility is a significant advantage over conventional fitted sheets and mattress pads.

Various embodiments of present disclosure are described in the following clauses:

Clause 1. An apparatus for adjustably covering a transportable sleeping platform for a user, the apparatus comprising: a multilayer textile assembly having a longitudinal axis and a transverse axis for conformingly coupling to the transportable sleeping platform comprising: a first textile layer comprising a first textile piece with a contact surface that faces away from the transportable sleeping platform during usage for sleeping and a sleeve top surface opposite the contact surface; a second textile layer comprising a second textile piece with a sleeve bottom surface that faces away from the transportable sleeping platform when covering the transportable sleeping platform, and a moisture barrier surface that faces toward the transportable sleeping platform when covering the transportable sleeping platform, wherein: two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer comprising one or more envelope enclosures configured to foldably enclose the one or more sleeve openings along one or both of the transverse edges of the sleeve formed between the first textile layer and the second textile layer.

2. The apparatus of clause 1, wherein the second textile layer comprises at least one of polyurethane laminate (PUL), thermoplastic polyurethane (TPU), cotton with TPU film, microfiber, nylon, textured synthetic fabric, cotton, or wool.

3. The apparatus of clause 1, further comprising the third textile layer, wherein the third textile layer comprises a selectively insertable padding layer.

4. The apparatus of clause 3, wherein the third textile layer comprising the selectively insertable padding layer is omitted from being inserted in the sleeve for circumstances in which padding would pose a potential suffocation risk for the user when the user is an infant or another person at risk for suffocation during sleep.

5. The apparatus of clause 4, wherein the third textile layer comprising the selectively insertable padding layer comprises a selectable thickness for accommodating the user with a set of predetermined body characteristics in a predetermined set of environmental conditions.

6. The apparatus of clause 3, wherein for the user that is a toddler, the selectively insertable padding layer comprises a thickness of between about 10 mm and about 30 mm.

7. The apparatus of clause 3, wherein the selectively insertable padding layer comprises a foam material.

8. The apparatus of clause 3, wherein the sleeve comprises openings at a first transversal end and at a second transversal end to facilitate: insertion of the selectively insertable padding layer through a first opening of the sleeve at the first transversal end; and adjustment or removal of the selectively insertable padding layer through a second opening of the sleeve at the second transversal end.

9. The apparatus of clause 3, wherein one or more layers chosen from the group consisting of the first textile layer, the second textile layer, the third textile layer, the fourth textile layer, and combinations thereof, are selected based a predetermined combination of one or more characteristics chosen from softness, durability, drape, texture, finish, physical weight, thickness, breathability, and/or moisture wicking.

10. The apparatus of clause 3, wherein one or more layers chosen from the group consisting of the first textile layer, the second textile layer, the third textile layer, the fourth textile layer, and combinations thereof, comprise a cooling material that promotes airflow and/or moisture wicking in a direction towards the transportable sleeping platform.

11. The apparatus of clause 3, wherein one or more layers chosen from the group consisting of the first textile layer, the second textile layer, the third textile layer, the fourth textile layer, and combinations thereof, comprise an insulating material that reduces a rate of heat transfer in a direction towards the transportable sleeping platform.

12. The apparatus of clause 2, wherein one or more layers chosen from the group consisting of the first textile layer, the second textile layer, the third textile layer, the fourth textile layer, and combinations thereof, comprise a thermoregulating material selected to: promote cooling via moisture wicking in a direction towards the transportable sleeping platform for use in warm environmental conditions; and trap air to reduce a rate of heat transfer in the direction towards the transportable sleeping platform for use in cool environmental conditions.

13. The apparatus of clause 12, wherein the thermoregulating material is selected from the group consisting of cotton, natural wool, synthetic wool, natural latex, bamboo-derived viscose, synthetic performance fabric, and combinations thereof.

14. The apparatus of clause 2, wherein the one or more envelope enclosures are selectively foldable to at least partially enclose a folded arrangement of the first textile layer, the second textile layer, and the third textile layer to form a pillow or cushion for the user.

15. The apparatus of clause 2, wherein the fourth textile layer comprises a textile selected based a predetermined combination of one or more characteristics chosen from softness, durability, drape, texture, finish, physical weight, thickness, breathability, and/or moisture wicking, and the first textile layer and the fourth textile layer are aesthetically different from one another.

16. The apparatus of clause 8, wherein at least one inward-facing surface of the sleeve comprises a friction-enhancing textured material to minimize slippage of the third textile layer within the sleeve.

17. A transportable sleep system comprising: a transportable sleeping platform; and an adjustable covering for the transportable sleeping platform for a user, wherein the adjustable covering comprises: a multilayer textile assembly having a longitudinal axis and a transverse axis for conformingly coupling to the transportable sleeping platform comprising: a first textile layer comprising a first textile piece with a contact surface that faces away from the transportable sleeping platform during usage for sleeping and a sleeve top surface opposite the contact surface; a second textile layer comprising a second textile piece with a sleeve bottom surface that faces away from the transportable sleeping platform when coupled to the transportable sleeping platform and a moisture barrier surface that faces toward the transportable sleeping platform when coupled to the transportable sleeping platform, wherein: two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer comprising one or more envelope enclosures configured to foldably enclose the one or more sleeve openings along one or both of the transverse edges of the sleeve formed between the first textile layer and the second textile layer.

18. The transportable sleep system of clause 17, wherein the transportable sleeping platform is a removable sleeping surface of crib or a foldable play structure.

19. The transportable sleep system of clause 17, wherein the transportable sleeping platform is configured for use in a vehicle.

20. The transportable sleep system of clause 17, wherein the transportable sleeping platform is configured for camping outside of a vehicle.

What is claimed is:

1. An apparatus for adjustably covering a transportable sleeping platform for a user, the apparatus comprising:

a multilayer textile assembly having a longitudinal axis and a transverse axis for conformingly coupling to the transportable sleeping platform comprising:

a first textile layer comprising a first textile piece with a contact surface that faces away from the transportable sleeping platform during usage for sleeping and a sleeve top surface opposite the contact surface;

a second textile layer comprising a second textile piece with a sleeve bottom surface that faces away from the transportable sleeping platform when covering the transportable sleeping platform, and a moisture barrier surface that faces toward the transportable sleeping platform when covering the transportable sleeping platform, wherein:

two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer comprising one or more envelope enclosures configured to foldably enclose the one or more sleeve openings along one or both of the transverse edges of the sleeve formed between the first textile layer and the second textile layer.

2. The apparatus of claim 1, wherein the second textile layer comprises at least one of polyurethane laminate (PUL), thermoplastic polyurethane (TPU), cotton with TPU film, microfiber, nylon, textured synthetic fabric, cotton, or wool.

3. The apparatus of claim 1, further comprising the third textile layer, wherein the third textile layer comprises a selectively insertable padding layer.

4. The apparatus of claim 3, wherein the third textile layer comprising the selectively insertable padding layer is omitted from being inserted in the sleeve for circumstances in which padding would pose a potential suffocation risk for the user when the user is an infant or another person at risk for suffocation during sleep.

5. The apparatus of claim 4, wherein the third textile layer comprising the selectively insertable padding layer comprises a selectable thickness for accommodating the user with a set of predetermined body characteristics in a predetermined set of environmental conditions.

6. The apparatus of claim 3, wherein for the user that is a toddler, the selectively insertable padding layer comprises a thickness of between about 10 mm and about 30 mm.

7. The apparatus of claim 3, wherein the selectively insertable padding layer comprises a foam material.

8. The apparatus of claim 3, wherein the sleeve comprises openings at a first transversal end and at a second transversal end to facilitate:

insertion of the selectively insertable padding layer through a first opening of the sleeve at the first transversal end; and adjustment or removal of the selectively insertable padding layer through a second opening of the sleeve at the second transversal end.

9. The apparatus of claim 3, wherein one or more layers chosen from the group consisting of the first textile layer, the second textile layer, the third textile layer, the fourth textile layer, and combinations thereof, are selected based a predetermined combination of one or more characteristics chosen from softness, durability, drape, texture, finish, physical weight, thickness, breathability, and/or moisture wicking.

10. The apparatus of claim 3, wherein one or more layers chosen from the group consisting of the first textile layer, the second textile layer, the third textile layer, the fourth textile layer, and combinations thereof, comprise a cooling material that promotes airflow and/or moisture wicking in a direction towards the transportable sleeping platform.

11. The apparatus of claim 3, wherein one or more layers chosen from the group consisting of the first textile layer, the second textile layer, the third textile layer, the fourth textile layer, and combinations thereof, comprise an insulating material that reduces a rate of heat transfer in a direction towards the transportable sleeping platform.

12. The apparatus of claim 2, wherein one or more layers chosen from the group consisting of the first textile layer, the second textile layer, the third textile layer, the fourth textile layer, and combinations thereof, comprise a thermoregulating material selected to:

promote cooling via moisture wicking in a direction towards the transportable sleeping platform for use in warm environmental conditions; and trap air to reduce a rate of heat transfer in the direction towards the transportable sleeping platform for use in cool environmental conditions.

13. The apparatus of claim 12, wherein the thermoregulating material is selected from the group consisting of cotton, natural wool, synthetic wool, natural latex, bamboo-derived viscose, synthetic performance fabric, and combinations thereof.

14. The apparatus of claim 2, wherein the one or more envelope enclosures are selectively foldable to at least partially enclose a folded arrangement of the first textile layer, the second textile layer, and the third textile layer to form a pillow or cushion for the user.

15. The apparatus of claim 2, wherein the fourth textile layer comprises a textile selected based a predetermined combination of one or more characteristics chosen from softness, durability, drape, texture, finish, physical weight, thickness, breathability, and/or moisture wicking, and the first textile layer and the fourth textile layer are aesthetically different from one another.

16. The apparatus of claim 8, wherein at least one inward-facing surface of the sleeve comprises a friction-enhancing textured material to minimize slippage of the third textile layer within the sleeve.

17. A transportable sleep system comprising:

a transportable sleeping platform; and an adjustable covering for the transportable sleeping platform for a user, wherein the adjustable covering comprises:

a multilayer textile assembly having a longitudinal axis and a transverse axis for conformingly coupling to the transportable sleeping platform comprising:

a first textile layer comprising a first textile piece with a contact surface that faces away from the transportable sleeping platform during usage for sleeping and a sleeve top surface opposite the contact surface;

a second textile layer comprising a second textile piece with a sleeve bottom surface that faces away from the transportable sleeping platform when coupled to the transportable sleeping platform and a moisture barrier surface that faces toward the transportable sleeping platform when coupled to the transportable sleeping platform, wherein:

two longitudinal edges of the second textile layer are respective coupled to two longitudinal edges of the first textile layer to form a sleeve for receiving a third textile layer, when present, through one or more sleeve openings between one or both transverse edges of the sleeve top surface and the sleeve bottom surface; and the second textile layer is shorter longitudinally than the first textile layer; and a fourth textile layer comprising one or more envelope enclosures configured to foldably enclose the one or more sleeve openings along one or both of the transverse edges of the sleeve formed between the first textile layer and the second textile layer.

18. The transportable sleep system of claim 17, wherein the transportable sleeping platform is a removable sleeping surface of crib or a foldable play structure.

19. The transportable sleep system of claim 17, wherein the transportable sleeping platform is configured for use in a vehicle.

20. The transportable sleep system of claim 17, wherein the transportable sleeping platform is configured for camping outside of a vehicle.

* * * * *